United States Patent [19]

Dierickx

[11] Patent Number: 4,993,076

[45] Date of Patent: Feb. 19, 1991

[54] CHEST PROTECTOR

[76] Inventor: Edward G. Dierickx, 2927 Hunter Way, West Linn, Oreg. 97068

[21] Appl. No.: 383,867

[22] Filed: Jul. 21, 1989

[51] Int. Cl.[5] ..... A41D 13/00

[52] U.S. Cl. ..... 2/2; 2/2.5; 2/267

[58] Field of Search ..... 2/2, 2.5, 92, 22, 44, 2/267, 268

[56] References Cited

U.S. PATENT DOCUMENTS

| | | | |
|---|---|---|---|
| 476,503 | 6/1892 | Woodward | 2/92 |
| 817,656 | 4/1906 | McCalla | 2/2 |
| 833,546 | 10/1906 | Pierce | 2/22 |
| 925,851 | 6/1909 | Sullivan | 2/2 |
| 932,352 | 8/1909 | Sullivan | 2/2 |
| 1,670,239 | 5/1928 | Cline | 2/2 |
| 1,970,130 | 8/1934 | Dickenson | 2/2 |
| 2,001,508 | 5/1935 | Tobin | 2/2 |
| 2,437,054 | 3/1948 | Tatai | 2/268 |
| 2,438,072 | 3/1948 | Piccinni | 2/268 |
| 2,471,071 | 5/1949 | McDonald | 2/2.5 |
| 2,553,612 | 5/1951 | Taylor | 2/22 |
| 2,786,209 | 3/1957 | Kleinman | 2/268 |
| 3,076,197 | 2/1963 | Glahe | 2/2 |
| 3,125,762 | 3/1964 | Glahe | 2/2 |
| 3,514,786 | 6/1970 | Terwilliger | 2/2.5 |
| 3,574,861 | 4/1971 | Hale | 2/2 |
| 4,213,202 | 7/1980 | Larry | 2/2 |
| 4,272,847 | 6/1981 | Buhler | 2/2 |
| 4,322,858 | 4/1982 | Douglas | 2/2 |
| 4,373,211 | 2/1983 | Goudreau et al. | 2/2 |
| 4,422,183 | 12/1983 | Landi et al. | 2/2 |
| 4,525,875 | 7/1985 | Tomczak | 2/2.5 X |
| 4,829,992 | 5/1989 | Cilladi et al. | 2/22 X |
| 4,847,913 | 7/1989 | Chen | 2/2 |
| 4,872,215 | 10/1989 | Sliger | 2/102 X |

FOREIGN PATENT DOCUMENTS

| | | | |
|---|---|---|---|
| 812317 | 5/1937 | France | 2/2.5 |
| 861120 | 2/1941 | France | 2/2.5 |

*Primary Examiner*—Werner H. Schroeder
*Assistant Examiner*—Jeanette E. Chapman
*Attorney, Agent, or Firm*—Dellett, Smith-Hill and Bedell

[57] ABSTRACT

A light-weight, shock-absorbing chest protector worn, for example, by participants in sports, the protector allowing air circulation to a wearer's body while providing enhanced flexibility. The protector conforms to a wearer's body and flexes inwardly and outwardly and expands and contracts vertically with the wearer's movements. The protector, which is coated with a durable coating to add color as well as additional strength to the protector, is attached to a wearer's body through the use of a harness. Apertures through the protector are shaped to "grab" a ball which strikes the protector and drop the ball near to the wearer, while also reducing the weight of the protector, providing air circulation through the protector, and giving the protector the enhanced flexibility. The protector has optional hinged pads for covering additional areas of a wearer's body without inhibiting freedom of movement.

28 Claims, 4 Drawing Sheets

CHEST PROTECTOR

This invention relates to chest protectors, and more specifically to chest protectors worn by catchers or umpires in baseball games.

BACKGROUND OF THE INVENTION

Baseball catchers or umpires typically wear chest protectors to prevent injury resulting from being struck by a baseball in the chest or shoulder region. Early chest protectors were generally made of cloth sewn in horizontal ribs to allow up and down flexibility, with vertical seams to provide front to back flexibility. These chest protectors typically included a vertical seam at the center of the protector which reduced the shock absorbing properties of the protector in the center of the chest where the shock absorbency was most needed. Glahe U.S. Pat. No. 3,076,197 resolved this problem by displacing the vertical seams to the sides away from the center of the protector. Further improvements moved the seams around so as to provide better flexibility and protection to the wearer as shown in Glahe U.S. Pat. No. 3,125,762.

A further attempt at providing additional protection involved the addition of rigid plates within the body of the chest protector as illustrated in Tomczak U. S. Pat. No. 4,525,875. However, one problem with protectors that are fairly rigid is that a ball which strikes the protector in a rigid area will bounce in an unpredictable direction, thereby reducing the likelihood that a catcher will be able to catch the ball.

These chest protectors also had a major drawback since they did not allow air circulation between the body of the wearer and the protector thereby causing an insulating effect. It was typical for a catcher to lose weight during a baseball game from perspiring excessively. Later devices added air holes to the chest protectors for breathing, for example, Buhler, U.S. Pat. No. 4,272,847, Gourdreau et al, U.S. Pat. No. 4,373,211, and Landi et al, U. S. Pat. No. 4,422,183, all included breathing holes.

Later chest protector devices have been constructed from foam materials for providing lighter weight shields. For example, the Buhler device uses an open cell foam which is coated on an inner layer with a water impervious coating to prevent the protector from absorbing the user's perspiration.

A common problem with chest protectors has been their lack of flexibility. For example, when a catcher kneels or bows his back to create a concave area for corralling the ball, a chest protector will typically bow outwardly rather than molding to the catcher's body thereby defeating or hindering the catcher's efforts at creating an area to confine the ball. Also, to provide freedom of movement, for example in the area of a catcher's throwing arm, protectors leave an area of the catcher's body uncovered. While allowing greater movement, uncovering a portion of a wearer's body subjects that portion to greater risk of injury.

SUMMARY OF THE INVENTION

The present invention relates to a light weight, closed cell foam Chest protector, shaped generally to conform to the wearer's body. The protector has a multiplicity of diamond shaped holes which allow air to circulate to and from the catcher's body thereby reducing the insulation effect present in earlier chest protector devices.

Furthermore, the holes are shaped and arranged so as to allow the protector to flex inwardly when struck by a ball and wrap around the ball, causing ball to drop downwardly in a predictable manner rather than allowing the ball to bounce wildly. The diamond shapes will generally "grab" the ball therewithin, killing the ball's rebound. For example, with a typical chest protector, if a catcher has turned partially sideways relative to the direction of travel of a ball, the ball glancing off the protector may rebound quite a distance away from the catcher; however, the present invention will drop the ball somewhat nearer the catcher. These holes also significantly reduce the weight of the protector; the preferred embodiment of the present invention weighs approximately 19 ounces. Finally, these holes are placed so as to allow greater flexing along certain axes of the protector, thus allowing the protector to move freely with and conform to the catcher's body. This freedom of movement enhances protector functionality and wearer comfort.

A catcher in a baseball game will typically bow his back to create a concave area within which to corral the ball. Protectors without the flexibility and collapsibility of the present invention tend to pooch or bow outwardly, defeating the effects of the catcher's bowing of his back. The present invention molds to the wearer's body, collapsing appropriately with body movement.

The present protector is provided with concave regions on the left and right side of the protector to allow freedom of movement of a wearer's arms. For example, when corralling a bunt a catcher will use both arms, and the combination of the convex areas and rows of diamond-shaped holes allow the protector to move with the catcher's body.

Additionally, an embodiment of the protector includes optional hinged plates attached to the upper portions or lower edge of the protector. These hinge plates cover the catcher's shoulder and groin areas and protect these body portions from being injured by stray baseballs.

In a preferred embodiment of the invention, the protector is manufactured from two layers of closed cell foam, the outer layer of foam being denser and less flexible and having greater shock absorbing properties than the inner layer of foam. This multilayer construction allows increased shock absorbing properties while retaining protector flexibility and wearing comfort. The harder outer shell typically takes the severe blow of a ball, and the attachment of the inner layer to the outer layer mitigate the shock from the ball over a larger area. The inner layer, which is softer, is worn against the wearer's body and provides more comfort to the wearer, since the inner layer is not as rough as the outer layer and flexes better with the wearer's body than would the outer layer. A single layer construction with sufficient shock absorbing properties would typically not be as comfortable to a wearer nor as flexible as the present invention. Ordinarily the inner layer is thicker than the outer layer, and the layers are adhered together with glue. The preferred method of manufacturing applicant's device is to pass two different layers of foam from separate rolls through a series of rollers which apply glue to the layers and compress the layers together. The two layers come out of the process in one single sheet which is die cut to the preferred pattern, for example, with a roller die process.

The entire protector is suitably coated with a finish, for example, a urethane resin, which adds color to the protector and actually increases the strength of the protector. The colors can be varied to match school or team colors. The spray finish is very durable yet flexible and adds strength to assist in preventing punctures and tears in the protector if, for example, a baseball player, while wearing cleats, steps on the protector. While in the preferred embodiment the finish is sprayed on, alternative methods of applying other finish types are possible, for example, roller application or dipping application.

It is accordingly an object of the present invention to provide an improved chest protector which is lightweight and flexible but still retains good shock absorbing properties.

It is a further object of the present invention to provide an improved chest protector which molds to and flexes with a wearer's body.

Another object of the present invention is to provide an improved chest protector which may be adapted to be worn by umpires and both right and left handed wearers.

Yet another object of the present invention is to provide an improved chest protector which reduces bounce and ricochet of a ball striking the protector.

A still further object of the present invention is to provide an improved chest protector which allows air circulation to the wearer's body while retaining protector shock absorbency.

The subject matter of the present invention is particularly pointed out and distinctly claimed in the concluding portion of this specification. However, both the organization and method of operation, together with further advantages and objects thereof, may best be understood by reference to the following description taken in connection with accompanying drawings wherein like reference characters refer to like elements.

DETAILED DESCRIPTION

Figure 1:
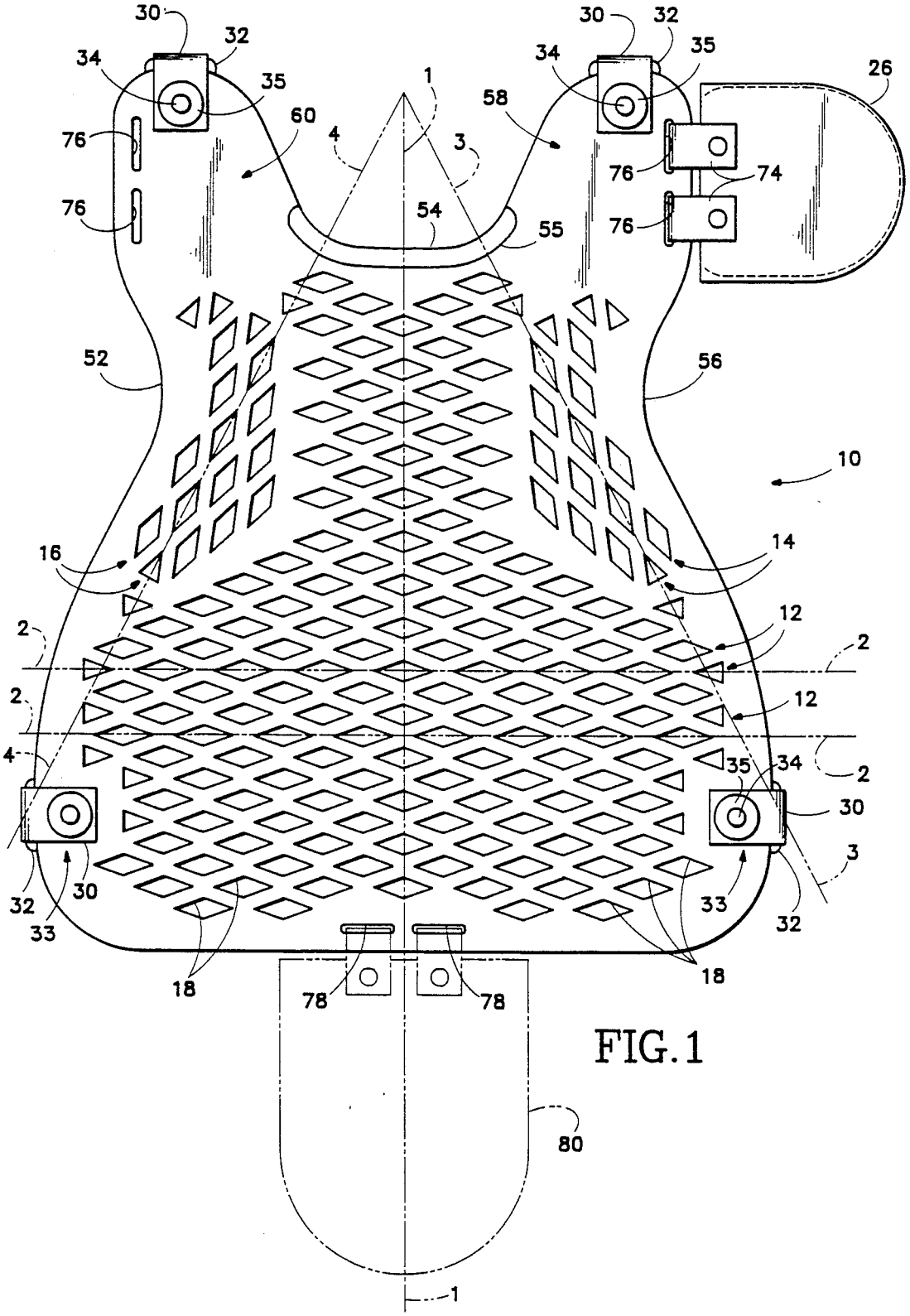
FIG. 1 is a perspective view of a chest protector embodying the invention.
Figure 5:
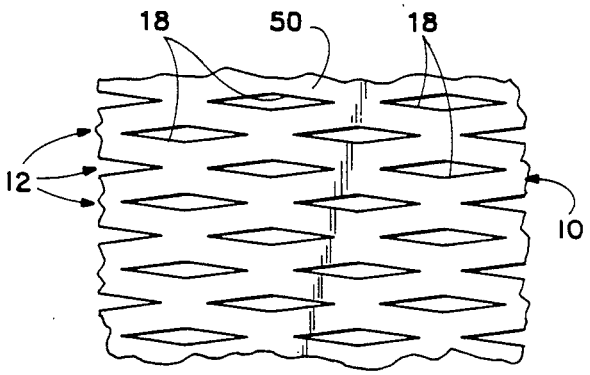
FIG. 5 is a partial view of the protector illustrating how the holes compress.

FIG. 1 is an overall view of the chest protector 10, for use when playing baseball, softball, or the like, as considered from the front, i.e., the side away from the wearer. The protector 10, which is symmetrical along vertical center line 1—1, is in general formed from flat foam material of appropriate size to forwardly cover the trunk of the human body and is provided with concave side edges 52 and 56 as well as a concave upper edge 54. Concave edge 56 allows the wearer's catching arm to move freely while concave edge 52 allows the protector to fit the wearer without restricting the wearer's throwing arm movements. Concave edge 54 allows the protector to fit the wearer without restricting the wearer's neck and head movements. Protector 10 also includes a throat guard 55 for reducing neck abrasion caused by rubbing against protector concave edge 54. Throat guard 55 can be constructed of, for example, vinyl or leather, and attached to the protector 10 by glue. The protector is provided with a plurality of holes 18 extending therethrough and disposed in rows 12, 14 and 16, with these holes being diamond shaped in the preferred embodiment because the diamond-shaped holes collapse symmetrically. FIG. 5 is a partial view of the chest protector with the holes compressed, showing enhanced collapsing properties. The arrangement of the diamond shaped holes, in nested arrangement from the standpoint of adjacent horizontal rows 12, is such as to allow greater flexibility along predetermined axes of the chest protector (e.g. in the direction of center line 1—1), while retaining the shock absorbency and strength of the protector.

Referring again to FIG. 1, in the preferred embodiment of the invention imaginary vertical lines through columns along the minor axes of diamond shaped holes 18 of a first row of holes will pass through the minor axes of corresponding holes in alternate rows of holes, and will pass equidistant between the end points along the major axes of two adjacent holes along rows adjacent said first row. The horizontal rows of holes 12, covering most of the central area of the protector, provide greater flexibility around axes 2—2, allowing the protector to flex in and out of its plane. The major axis of each hole 18 in rows 12 is, in the preferred embodiment, parallel to the bottom edge of protector 10. Rows of holes 12, in conjunction with the diamond shape of the holes, further provide the protector with the ability to expand or contract within the plane of the protector, along axis 1—1. This expansion and contraction assists in molding the protector to the wearer's body as the wearer is moving, and helps prevent the protector from undesirably bowing or pooching outwardly when the wearer bends his body. The flexibility thus permits the chest protector to mold to the catcher's body and to bend in and out as the catcher bends forwardly and backwardly.

The rows of holes 16 near concave edge 52 provide greater flexibility around the axis 4—4 of the protector. The major axis of each hole 18 in rows 16 in the preferred embodiment is at an angle of approximately 70° relative to the bottom edge of protector 10. The enhanced flexibility around this axis allows greater freedom of movement to the wearer, if right-handed, in throwing a ball.

The rows of holes 14 near concave edge 56 provide greater flexibility around the axis 3—3 of the protector 10. The major axis of each hole 18 in rows 14 is, in the preferred embodiment, at an angle of approximately 110° relative to the bottom edge of protector 10. This axis of flexibility allows the protector to move with the catcher's catching arm, if the catcher is right-handed. One adult version of the protector included twenty-nine rows of holes 12, four rows of holes 14 and four rows of holes 16. A youth version of the protector has holes of the same dimension as those in the adult version, but with fewer rows and columns of holes.

The protector also includes optional hinge flaps 26 attachable to either upper side of the protector for covering and protecting the catcher's shoulders. These hinge flaps, which are suitably formed from the same foam material as the protector, provide additional protection to the wearer's shoulders from injury by stray balls but are hinged so as to minimize restricting the wearer's arm movement. Hinge flaps 26 are connected to chest protector 10 via straps 74 which feed through holes or slots 76 in the protector. Straps 74 may be attached to a flap 26 or to a nylon bag containing flap 26 by means of snaps or Velcro connections wherein the straps pass through slots 76 and double back on themselves. The upper pad portions 58 and 60 of the protector 10 on either side of the neck do not contain any holes. This absence of holes in regions 58 and 60 provides a durable attachment point for the hinge flaps 26.

A further embodiment of the protector includes holes 78 at the bottom edge of the protector for attaching a further protecting flap 80 to protect the groin region of a catcher. The additional flap 80 can be added as desired or required by differing league regulations. The use of hinge flaps 26 and additional flap protectors 80 have the further advantage of reducing manufacturing waste since these pieces 26 and 80 of the device can be produced using material that results from the die cutting of the protector 10, for example, in concave regions 52 and 56. A still further advantage of these attachment pads 26 and 80 is the ability to customize the protector to an additional application. For example, an umpire in a baseball or softball gate stands in a manner which exposes both his collar bones to injury from stray balls. Therefore, an umpire can attach hinge flaps 26 to both the upper left and upper right sides of a protector. A left-handed catcher would also likely want additional protection on the right side of the body and would therefore add a hinge flap 26 to the right side of the protector, whereas a right-handed catcher would want the additional protection flap on the left side. A catcher with an arm injury could add a flap over the injured arm for additional protection.

Figure 2:
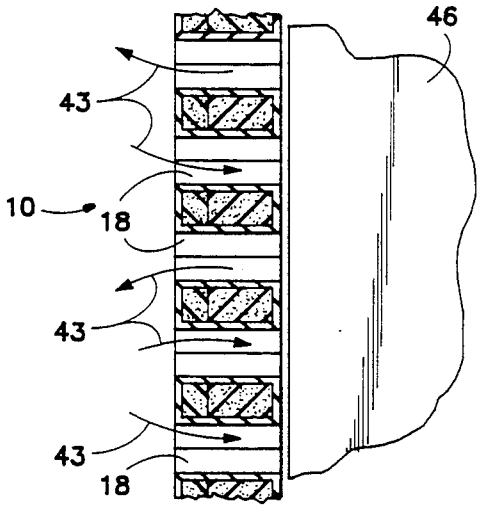
FIG. 2 is a side sectional view of the protector and depicts the air flow from the atmosphere through the protector and to the wearer's body.
Figure 4:
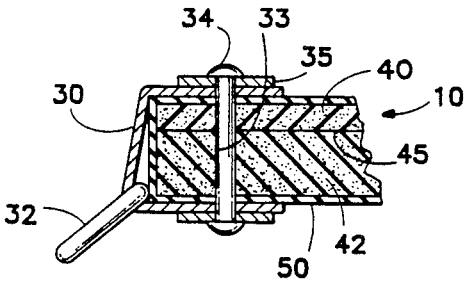
FIG. 4 is a cross section detail of the chest protector illustrating the strap attachment method.
Figure 3:
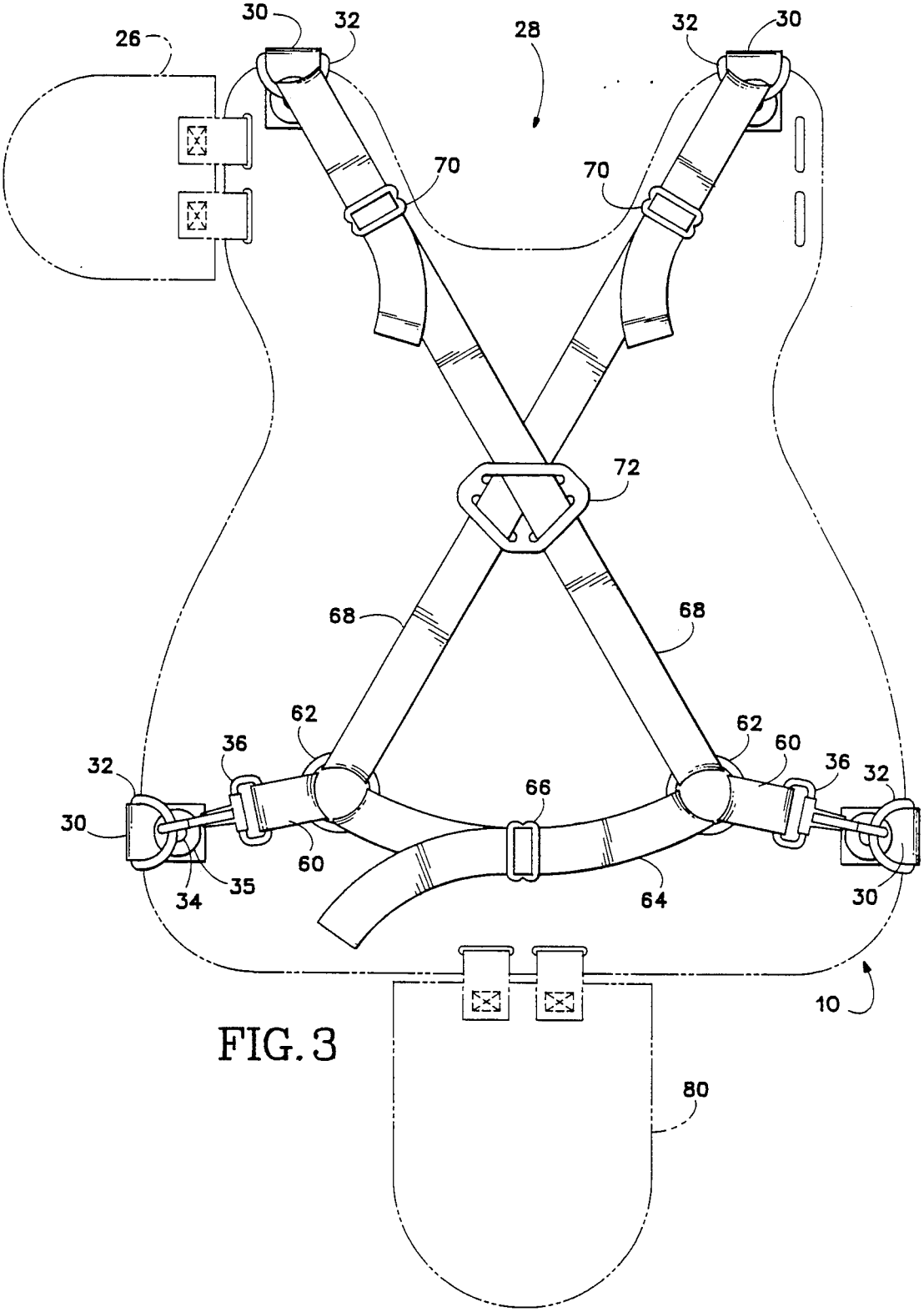
FIG. 3 is a view of the strap mechanism for attaching the protector to a wearer.

Of course, as previously stated, an important feature of the holes 18 is also to allow airflow between the catcher's body and the protector, thereby reducing the insulating effect of the protector and reducing perspiration by the catcher. FIG. 2 illustrates the air flow 43 passing through the holes 18 to the catcher's or wearer's body 46. The protector is held to the wearer's body by means of a harness 28, illustrated in greater detail in FIGS. 3 and 4. Attachment links 30, constructed of, for example, nylon webbing, run from the front of the protector 10 to the back of the protector passing through rings 32 and are attached to protector 10 by means of rivets 34 and washers 35 wherein the washers 35 prevent rivets 34 from pulling through protector 10. Holes 33, at the four corners of the protector, receive the rivets. The lower end of harness 28 attaches to protector 10 through snap hooks 36 each connected via a loop of webbing 60 to a metal ring 62. The snap hooks 36 allow the harness 28 to be removed from the protector for quick donning or removal from the wearer. Left and right rings 62 are interconnected via a flexible strap 64 which runs horizontally across the lower back of the wearer and is provided with a horizontal length adjuster 66. Rings 62 are further connected to flexible straps 68, which criss-cross, and which extend to and are attached to the opposite upper edges of chest protector 10. This upper attachment is accomplished via additional webbing links 30, rings 32, rivets 34, and washers 35. The straps 68 in this case loop through rings 32 and also include vertical length adjusters 70 for changing tension of the straps 68. The straps 68 criss-cross through a slotted buckle 72 which provides positioning of the criss-cross point. The criss-cross arrangement of the straps adapts the protector to conform more closely to a wearer's body. As an alternative to the harness method, the protector can be held to a wearer's body by placement underneath the wearer's shirt.

Figure 6:
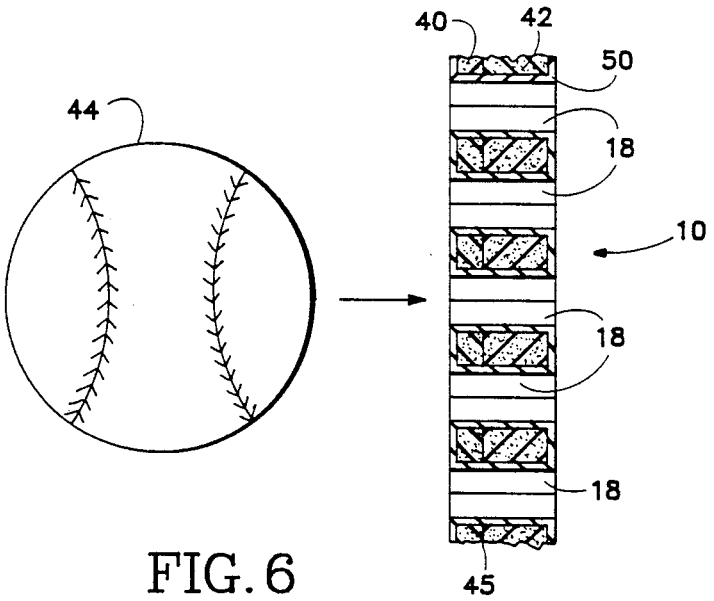
FIG. 6 is a cross sectional view of the chest protector.

FIG. 6 is a cross sectional view of the protector 10 showing the construction of various layers. The outer flat layer 40, is a higher density material with greater shock absorbency properties than inner flat layer 42 which is more flexible and generally thicker than the outer layer 40. The harder outer layer 40 takes the severe blow of the ball 44, and the attachment of the inner layer 42 to the outer layer 40 mitigates the shock from the ball 44 over a larger area. The inner layer 42, which is softer, is worn against the wearer's body and provides more comfort to the wearer since the inner layer is not as rough and flexes better with the wearer's body than would the outer layer. These layers 40 and 42 were formed of a closed cell foam, in a specific embodiment comprising vinylnitrile sold under the name Ensolite, by Uniroyal Plastics Co., Inc. of Mishawaka, Indiana. In a preferred embodiment, the outer layer 40 is one-quarter inch in thickness, having a density of 7.5 to 9.5 $lb/in^3$ and having a compression resistance of 10.0 to 13.0 $lb/in^2$. The inner layer 42 is one-half inch thick, having a density of 6.0 to 8.5 $lb/in^3$ and a compression resistance of 4.0 to 6.0 $lb/in^2$. However, the thicknesses of the layers and other properties can be changed if desired. Thus, for example, the thickness of the outer layer may vary from one-quarter inch to one-half inch, while the thickness of the inner layer may vary from one-quarter inch to one inch.

In the preferred embodiment of the invention, the entire protector is coated with a finish 50, for example, Ultrathane ISU, manufactured by Futura Coatings, Inc., of Hazelwood, Missouri. This finish, in the preferred embodiment, was applied by spraying onto the protector. Finish 50 increases the durability of the protector 10 while retaining the protector's flexibility and allows the protector to be produced in a variety of colors, e.g. which correspond to school colors or team colors. The durability added by the finish assists in preventing punctures and tears in the protector if, for example, a baseball player, while wearing cleats, steps on the protector. Additionally, the harness assembly 28 can be produced in a variety of colors.

A ball 44 will typically strike the chest protector on the thinner, outer layer 40 as shown in FIG. 6. Holes 18 and the patterned arrangement of the holes 12 will cause the chest protector 10 to flex inwardly and wrap around the ball 44 as the ball strikes the protector 10. This wrapping will control the bounce of the ball, allowing the ball to drop downwardly rather than bounce unpredictably. Further, the diamond shape of holes 18 will generally "grab" ball 44 therewithin, killing the ball's rebound. The layers 40 and 42 also absorb the energy of the bounce of the ball.

Figure 7:
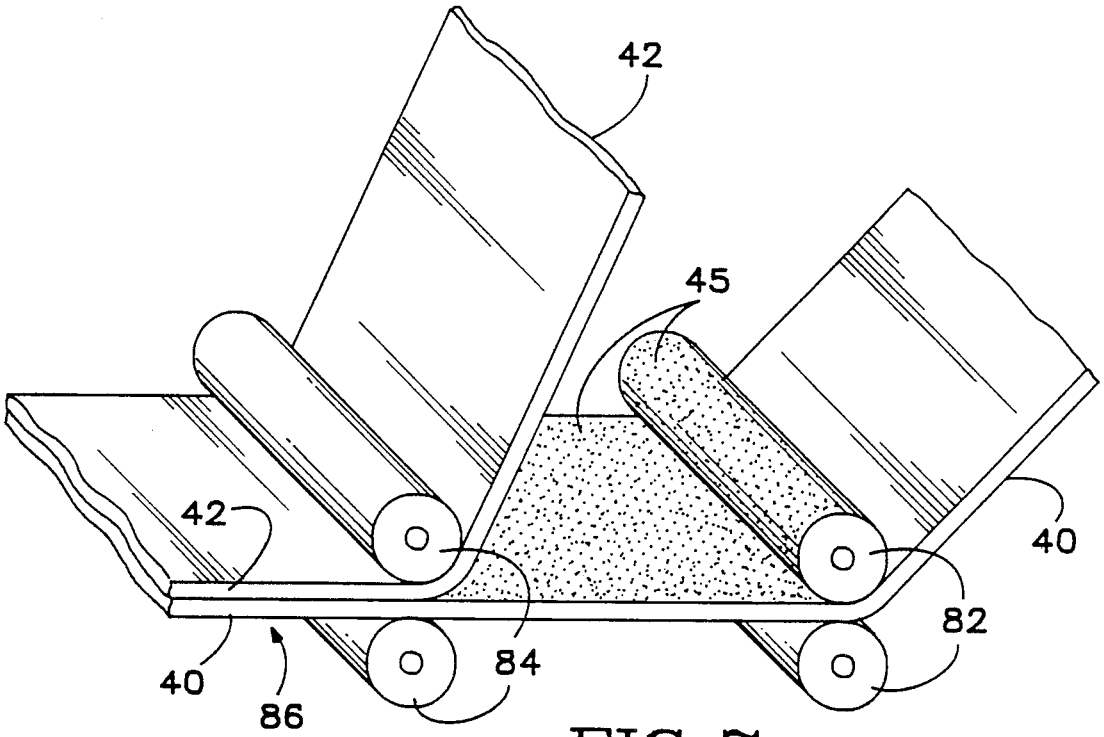
FIG. 7 is a view of a method of adhering the two protector layers together.

The preferred method of manufacturing the protector involves adhering the outer layer 40 to inner layer 42 by means of a glue layer 45, for example, 3M glue #1357. Referring to FIG. 7, which illustrates a method of adhering the protector layers together, first foam layer 40 is fed from a roll (not shown) through a first set of rollers 82. One of the rollers 82 is coated with glue 45, and the glue is transferred from roller 82 to a surface of foam 40. Then first foam layer 40 passes through a second set of rollers 84 together with second foam layer 42 fed from a roll (not shown). Rollers 84 press layer 42 to the glue-coated surface of layer 40, thereby adhering the layers together, and the two layers leave rollers 84 as one sheet 86 comprised of the two layers 40 and 42. In the preferred embodiment of the invention, the layers 40 and 42 are glued together in large sheets, and then the protectors are die cut from the sheets to the desired shape with a roller die process. The holes 18 and 33 of FIG. 1 are also die cut in the same process. Alternatively, a protector can be molded using a single layer, rather than being die cut. While the preferred embodiment of the invention uses a two-layer construction because a two-layer construction provides greater wearer comfort and greater flexibility than would one layer with sufficient shock absorbing properties, other versions of the invention could be produced using one layer or more than two layers.

The chest protector of the present invention thus provides lightweight shock absorbing properties, yet is durable and flexible. The chest protector reduces ball rebound, allows air to circulate to and from a wearer's body and molds to the wearer's body, collapsing up-down and in-out with body movement. The hinge flaps of the protector allow the protector to be adapted to suit particular protection needs of individual wearers.

While the invention has been described in terms of specific embodiments, these are not intended as limitations on the scope of the invention. Therefore, all variations or modifications to the embodiments shown herein are intended to be included within the scope of the invention, as expressed in the claims appended hereto.

What is claimed is:

1. An article for protecting a person's upper body, comprising:

a first lightweight flexible shock absorbing pad;

said first pad having concave midsection edges providing openings for the person's arms;

said first pad having convex upper sections providing protection for the person's shoulders;

a plurality of diamond-shaped apertures extending through said first pad, said apertures being arranged in a net-like lattice pattern with apertures offset in alternate rows and in nested relation for allowing the article to flex with and conform to the person's body; and means for attaching the article to the person.

2. The article according to claim 1 wherein said first pad is constructed of a resiliently compressible foam.

3. The article according to claim 1 wherein said first pad is constructed of first and second layers of resiliently compressible foam.

4. The article according to claim 3 wherein said first layer is adhered to said second layer, said first layer is thinner and has greater density than said second layer to provide greater shock absorbing properties, and said second layer is adapted to face the person's body.

5. The article according to claim 1 further comprising:

at least one removable pivotally attached second shock absorbing pad; and means for attaching said second pad to the article.

6. The article according to claim 5 wherein said means for attaching said second pad to the article comprises:

a plurality of openings through said first pad, said openings positioned so as to allow said second pad to protect an additional portion of the person's body;

a plurality of straps;

said plurality of straps extending through said openings; and means for removably attaching said plurality of straps to said second pad.

7. A chest protector for a person participating in sports, comprising:

a first lightweight flexible shock absorbing pad provided with a plurality of rhombic apertures extending therethrough;

said first pad being constructed of inner and outer layers of resiliently compressible foam, said inner layer being adapted to face the person's body;

said inner layer of foam being adhered to said outer layer of foam;

said outer layer having greater density and less flexibility than said inner layer to provide greater shock absorbing properties; and means for attaching the protector to the person.

8. The protector according to claim 7 further comprising:

a plurality of removable second shock absorbing pads, pivotally attached to said first pad.

9. The protector according to claim 7 wherein said apertures are arranged in a net-like pattern.

10. The protector according to claim 7 wherein said attachment means comprises a harness.

11. A chest protector for a person participating in sports, comprising:

a first lightweight flexible shock absorbing pad;

said first pad having a plurality of diamond shaped apertures extending through said pad, said apertures for imparting increased compressibility to said first pad along one axis of said apertures;

at least one second lightweight flexible shock absorbing pad;

means for removably and pivotally attaching said second pad to said first pad, said last mentioned means allowing quick attachment and removal of said second pad;

said first and second pads each being constructed of a first and second layer of resiliently compressible foam, said first and second layers being adhered to each other;

said first layer having greater density and less flexibility than said second layer, and said first and second pads having a durable, flexible coating;

a neck guard attached to the protector for reducing neck abrasion caused by rubbing against the protector; and means for attaching the protector to the person.

12. A chest protector for a person, said protector comprising:

a first pad;

said first pad having full width upper and lower regions;

said first pad having a narrow width mid-region with a transition from full width in said upper and lower regions to narrow width in said mid-region having a concave curve shape at a left and a right side edge of the pad;

said first pad having a concave region along the center upper edge of said first pad;

said first pad having a plurality of apertures extending therethrough providing air circulation, said apertures being shaped to provide greater collapsibility properties for said pad along a substantially vertical axis thereof;

said apertures being arranged in a net-like pattern enabling said pad to expand and contract along said vertical axis within the plane of said pad while allowing said pad to flex away from the plane of said pad;

means for removably attaching said first pad to the person; and a plurality of second pads removably and pivotally attached to said first pad;

wherein said first and second pads are constructed of urethane material with shock absorbing properties.

13. The protector according to claim 12 wherein said apertures are diamond shaped.

14. The protector according to claim 12 wherein said net-like pattern of apertures comprises:

a first area of said plurality of apertures wherein the axes of greatest collapsibility of said apertures in said first area are substantially perpendicular to the bottom edge of said protector;

said first area extending substantially from the bottom edge to the top edge of said protector.

15. The protector according to claim 14 further provided with a second area of said plurality of apertures, wherein the major axes of greatest collapsibility of said apertures in said second area are at an angle relative to the bottom edge of said protector, said second area being adjacent the mid-region concavity of the left side edge of said first pad; and a third area of said plurality of apertures, wherein the axes of greatest collapsibility of said apertures in said third area are at an angle relative to the bottom edge of said protector, said third area being adjacent the mid-region concavity of the right side edge of said first pad.

16. A chest protector for a person, said protector comprising:

a first pad;

at least one removable second pad;

said first and second pads being constructed of a first lightweight flexible shock absorbing layer and a second lightweight flexible shock absorbing layer coextensive with said first layer;

said protector having a plurality of diamond-shaped apertures extending through said first pad;

means for pivotally attaching said second pad to said first pad so as too allow said second pad to protect an additional portion of the person's body; and means for attaching said chest protector to the person.

17. The chest protector according to claim 16 wherein a said first layer has greater shock-absorbing properties and higher density than said second layer.

18. The protector according to claim 16 wherein said first and second layers are comprised of a closed cell foam.

19. The protector according to claim 16 wherein said first and second pads are coated with a durable finish.

20. The protector according to claim 16 wherein said first layer is thicker than said second layer.

21. The protector according to claim 20 wherein said first layer is approximately one-quarter inch to one-half inch thick and said second layer is approximately one-quarter inch to one inch thick.

22. A chest protector comprising:

a first pad having a plurality of holes extending therethrough, said plurality of holes arranges in a net-like pattern, each of said holes being shaped to collapse more readily along at least one axis of said hole.

23. The chest protector according to claim 22 wherein said first pad comprises a plurality of shock absorbing layers.

24. The chest protector according to claim 22 wherein said plurality of holes are substantially diamond shaped.

25. The chest protector according to claim 22 wherein said net-like pattern comprises a first group of said plurality of holes arranged along parallel lines, with the axes of greatest collapsibility of said holes in said first group being substantially perpendicular to a bottom edge of said protector for providing flexibility and aeration to said protector.

26. The chest protector according to claim 25 wherein said net-like pattern further comprises a second group of said plurality of holes arranged along a second set of parallel lines adjacent a vertical edge in the upper left quadrant of said protector, the axes of greatest collapsibility of said holes in said second group being at an angle for providing flexibility to said protector to allow flexing with the movement of an arm of a wearer.

27. The chest protector according to claim 25 wherein said net-like pattern further comprises a third group of said plurality of holes arranged along a third set of parallel lines adjacent a vertical edge in the upper right quadrant of said protector, the axes of greatest collapsibility of said holes at an angle for providing flexibility of said protector to allow flexing with the movement of the other arm of a wearer.

28. A chest protector comprising:

a shock absorbing pad with a plurality of apertures extending therethrough, said apertures arranged in a pattern so as to impart greater flexibility and compressibility to said pad along at least one axis of said pad.

* * * * *

UNITED STATES PATENT AND TRADEMARK OFFICE

CERTIFICATE OF CORRECTION

PATENT NO. : 4,993,076

DATED : February 19, 1991

INVENTOR(S) : Edward G. Dierickx

It is certified that error appears in the above-identified patent and that said Letters Patent is hereby corrected as shown below:

Column 5, line 25, delete "gate" and insert --game--.

Column 9, line 24, delete "major" before "axes".

Column 9, line 47, delete "too" and insert --to--.

Column 10, line 45, delete "of" and insert --to--.

Signed and Sealed this

Twenty-first Day of December, 1993

Bruce Lehman

*Attest:*

BRUCE LEHMAN

*Attesting Officer*

*Commissioner of Patents and Trademarks*